United States Patent [19]

Hunter

[11] Patent Number: 5,065,069

[45] Date of Patent: Nov. 12, 1991

[54] ARC DISCHARGE LAMP WITH SPRING-MOUNTED ARC TUBE, SHROUD AND FRAME

[75] Inventor: Scott R. Hunter, Rockport, Mass.

[73] Assignee: GTE Products Corporation, Danvers, Mass.

[21] Appl. No.: 623,141

[22] Filed: Dec. 6, 1990

[51] Int. Cl.[5] ..... H01J 61/34
[52] U.S. Cl. ..... 313/25
[58] Field of Search ..... 313/25

[56] References Cited

U.S. PATENT DOCUMENTS 3,250,934 5/1966 Peterson ..... 313/42 X
4,678,960 7/1987 Reiling ..... 313/25
4,888,517 12/1989 Keeffe et al. ..... 313/25

FOREIGN PATENT DOCUMENTS 467025 6/1937 United Kingdom ..... 313/25
815893 7/1959 United Kingdom ..... 313/25

*Primary Examiner*—Palmer C. DeMeo
*Attorney, Agent, or Firm*—Joseph S. Romanow

[57] ABSTRACT

A metal halide arc discharge lamp includes an arc tube and a light-transmissive shroud mounted within a lamp envelope. The arc tube and the shroud are mechanically attached to a frame. The frame is mechanically supported within the lamp envelope by resilient spring members. Since the frame is mechanically and electrically isolated from the lamp stem, leakage current between the frame and the electrical inleads is eliminated, thereby reducing sodium loss from the arc tube and extending the operating life of the lamp. The spring-mounted construction enables the lamp to withstand mechanical shock and vibration.

19 Claims, 6 Drawing Sheets

ARC DISCHARGE LAMP WITH SPRING-MOUNTED ARC TUBE, SHROUD AND FRAME

FIELD OF THE INVENTION

This invention relates to arc discharge lamps and, more particularly, to arc discharge lamps wherein the arc tube, shroud and frame are mounted within the lamp envelope with springs. The lamp has an extended operating life and the ability to withstand mechanical shock and vibration.

BACKGROUND OF THE INVENTION

High intensity metal halide arc discharge lamps include an arc tube sealed within a light-transmissive lamp envelope. Electrical energy is coupled through a lamp stem to the arc tube. Metal halide arc discharge lamps frequently include a shroud which provides performance and safety improvements. The shroud comprises a cylindrical, light-transmissive member, such as quartz, that is able to withstand the high operating temperatures of the lamp. The arc tube and the shroud are coaxially mounted within the lamp envelope, with the arc tube positioned within the shroud.

A shroud open at one end and having a domed configuration at the other end for use in a low wattage metal halide lamp is disclosed in U.S. Pat. No. 4,499,396 issued Feb. 12, 1985 to Fohl et al and U.S. Pat. No. 4,580,989 issued Apr. 8, 1986 to Fohl et al. The shroud is suggested as being useful in reducing heat loss from the arc tube by convection and thereby raising the temperature of the arc tube and increasing the vapor pressure of the volatile metal halide additives in the arc discharge. Sodium loss is stated to be reduced when the shroud is used in a qas-filled lamp envelope.

Sodium is an important constituent in most high intensity metal halide arc discharge lamps, usually in the form of sodium iodide or sodium bromide. Sodium is used to improve the efficacy and color rendering properties of these lamps. It has long been recognized that arc tubes containing sodium lose sodium during discharge lamp operation. Sodium is lost by the movement, or migration, of sodium ions through the arc tube wall. The iodide originally present in a metal halide lamp as sodium iodide is freed by sodium loss, and the iodide combines with mercury in the arc tube to form mercury iodide. Mercury iodide leads to increased reignition voltages, thereby causing starting and lamp maintenance problems.

In U.S. Pat. No. 4,281,274 issued July 28, 1981 to Bechard et al, a miniature arc tube containing sodium iodide is located within a gas-filled outer envelope. The arc tube is mounted within a shroud that is open at both ends. The shroud is electrically biased with a DC voltage in order to repel positive sodium ions which have migrated through the wall of the arc tube and to attract electrons produced in the lamp envelope by the photoelectric effect. This technique is not suitable for AC operation of an arc tube, since the positive bias is provided on the shroud only during one-half of the AC voltage cycle.

A prior attempt to reduce sodium loss from AC metal halide lamps was the use of a so-called "frameless construction" described in U.S. Pat. No. 3,424,935 issued Jan. 28, 1969 to Gungle et al. In the frameless construction, there are no frame members close to the arc tube. The electrical connection to the upper electrode is a fine tungsten wire spaced as far away from the arc tube as possible. Although this configuration reduces sodium loss, sodium loss is still evident near the end of the life of such lamps.

Another technique for reducing sodium loss is disclosed in U.S. Pat. Nos. 4,620,125 issued Oct. 28, 1986 to Keeffe et al and U.S. Pat. No. 4,625,141 issued Nov. 25, 1986 to Keeffe et al. A low wattage metal halide discharge lamp includes an evacuated envelope containing a heat reducing member and an arc tube within the heat reducing member. The heat reducing member and the arc tube have a metal band and an outer strap adjacent to one another and adjacent to one electrode. The metal band, outer strap and electrode are all electrically connected to an electrical lead of one polarity, whereby sodium loss from the arc tube is reduced.

Other techniques for reducing sodium loss from arc discharge lamps are disclosed by Keeffe et al in *Journal of Illumination Engineering Society*, Summer 1988, pages 39–43; U.S. Pat. No. 4,963,790 issued Oct. 16, 1990 to White et al; Japanese Patent No. 60-40138 published July 30, 1976 and U.S. Pat. No. 4,843,266 issued June 27, 1989 to Santo et al.

In the aforementioned U.S. Pat. No. 4,499,396 and U.S. Pat. No. 4,580,989, two techniques are disclosed for mounting the shroud in the lamp. In a first technique, the shroud is held in place by two shroud straps which are welded to a supporting frame. Straps positioned around each end of the arc tube are also welded to the frame and thereby support the arc tube. In a second technique, slots are cut in the shroud, and the shroud is held in place by the straps which support the arc tube. Although these lamps perform generally satisfactorily, the shroud straps permit excessive axial movement of the shroud during shipping and handling, and the slotted shroud tends to crack during manufacturing and operation.

These issues are addressed in pending application Ser. No. 07/539,752 filed June 18, 1990. The disclosed mounting arrangement includes a frame comprising one or two support rods, and upper and lower clips for retaining the shroud and the lamp capsule. The clips, which are welded to the support rods, prevent both axial and lateral movement of the shroud. The frame is attached to the base end of the lamp envelope by a strap which encircles the lamp stem.

Although the lamps disclosed in application Ser. No. 07/539,752 are mechanically strong and relatively simple to construct and are able to survive shipping and handling without significant breakage, these lamps have been found to have a shorter operating life than is known to be achievable. The shorter operating life is due primarily to an excessive rate of voltage rise and changes in the color temperature of the lamp during operation, which are indicative of sodium loss. One technique that has been used to increase the life of these lamps is to place a strip of insulating material under the strap which secures the frame to the lamp stem. The purpose of the insulating strip is to reduce leakage currents between the frame and the inleads to the arc tube. Although the insulating strip has been found to increase the life of the lamp, this modification is expensive to implement, increases the number of rejected lamps during the manufacturing process and does not increase the operating life to the extent desired.

Resilient bumpers, or bulb spacers, are used to stabilize an arc tube structure within a lamp envelope in the aforementioned U.S. Pat. No. 3,424,935. A spring extending between the dome end of a lamp envelope and the dome of a shroud is disclosed in the aforementioned U.S. Pat. No. 4,499,396. However, in all prior art known to applicant, the arc tube is generally rigidly mounted within the lamp envelope, and springs or other resilient members are used to supplement the rigid support and to stabilize the arc tube in a desired position.

It is a general object of the present invention to provide improved arc discharge lamps.

It is another object of the present invention to provide arc discharge lamps wherein voltage rise and changes in color temperature during the operating life of the lamp are limited.

It is a further object of the present invention to provide arc discharge lamps wherein sodium migration from the arc tube is suppressed.

It is yet another object of the present invention to provide arc discharge lamps which are capable of withstanding mechanical shock and vibration.

It is still another object of the present invention to provide arc discharge lamps which have long operating lives.

It is a further object of the present invention to provide arc discharge lamps which are simple in construction and low in cost.

SUMMARY OF THE INVENTION

According to the present invention, these and other objects and advantages are achieved in an electric lamp comprising a sealed lamp envelope including a lamp stem, a lamp subassembly located within the lamp envelope, means for coupling electrical energy through the lamp stem to the lamp subassembly, and plural resilient members coupled between the lamp subassembly and the lamp envelope for resilient mounting of the lamp subassembly. The plural resilient members provide mechanical support for the lamp subassembly in the lamp envelope. The lamp subassembly includes a lamp capsule for generating light upon application of electrical energy, a generally cylindrical, light-transmissive shroud disposed around the lamp capsule, first and second retainers attached to opposite ends of the lamp capsule and retaining the shroud between them and a frame extending between dome and base regions of the lamp envelope. The first and second retainers are attached to the frame. The frame is mechanically and electrically isolated from the lamp stem.

The resilient members preferably comprise springs coupled between the frame and the lamp envelope. The springs limit axial and radial movement of the lamp subassembly relative to a central axis of the lamp envelope. The frame can be generally U-shaped, including first and second rods extending along opposite sides of the shroud between dome and base regions of the lamp envelope and a cross member at the dome end of the lamp envelope. In a preferred embodiment, the springs include at least one angled spring coupled between the frame and the lamp envelope and oriented at an acute angle relative to the axis of the lamp envelope so as to limit both axial and radial movement of the lamp subassembly relative to the lamp envelope. The acute angle is preferably in a range of about 20°–70°. Electrical inleads extending through the lamp stem and connected to the lamp capsule each include a resilient portion which permits movement of the lamp subassembly relative to the lamp envelope.

According to another aspect of the invention, the frame further includes a reinforcing portion connected between the first and second rods near the base region of the lamp envelope. In one embodiment, the reinforcing portion comprises a lower cross member connected between the first and second rods. In a second embodiment, the reinforcing portion comprises a ring connected to the first and second rods. The ring can have any desired shape. The reinforcing portion of the frame is electrically isolated from the electrical inleads and the lamp stem.

BRIEF DESCRIPTION OF THE DRAWINGS

For a better understanding of the present invention, together with other and further objects, advantages and capabilities thereof, reference is made to the accompanying drawings which are incorporated herein by reference and in which.

DESCRIPTION OF THE PRIOR ART

Figure 1:
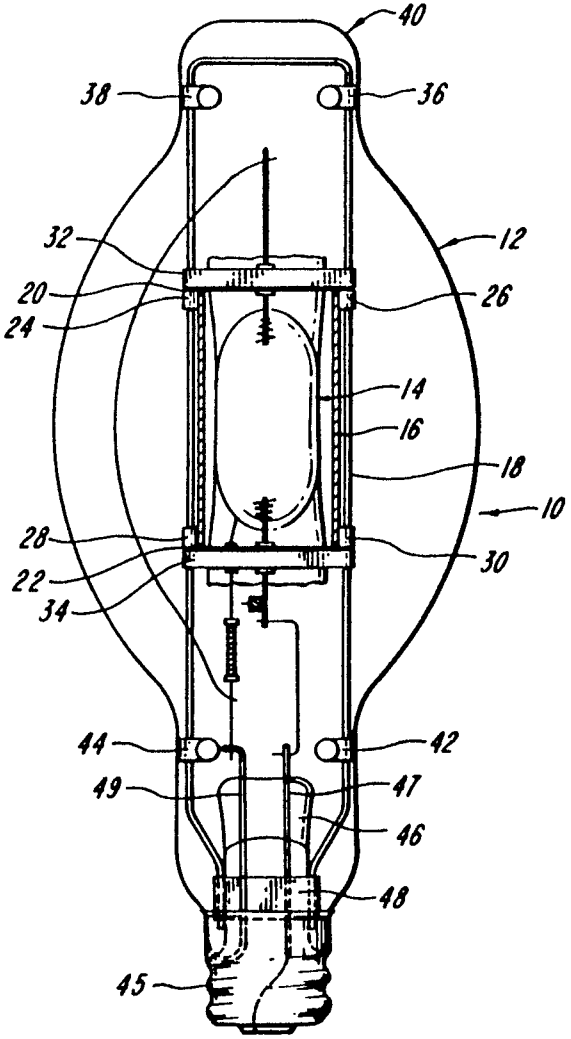
FIG. 1 is a cross-sectional view of an arc discharge lamp in accordance with the prior art.

A metal halide arc discharge lamp 10 in accordance with the prior art is shown in FIG. 1. The lamp 10 includes a lamp envelope 12 and an arc tube 14 mounted within the lamp envelope. The arc tube 14 is positioned within a cylindrical, light-transmissive shroud 16. The shroud 16 and the arc tube 14 are supported within the lamp envelope 12 by a frame 18. The shroud 16 is held in place such that it cannot move axially or radially by annular ring clips 20 and 22 located at opposite ends of shroud 16. The ring clips 20 and 22 are welded to the frame 18 by means of tabs 24 and 26 on clip 20 and tabs 28 and 30 on clip 22. The arc tube 14 is secured to frame 18 by straps 32 and 34 attached to opposite ends of the arc tube 14.

The frame 18 is secured within the lamp envelope 12 by stainless steel bulb spacers 36 and 38 at the dome end 40 of the lamp envelope 12 and by bulb spacers 42 and 44 at the base end of the lamp envelope. The bulb spacers limit radial movement of the frame 18 within the lamp envelope 12. In addition, the frame is secured to the lamp stem 46 by a stem strap 48 which surrounds the lamp stem 46 and is welded to frame 18. The strap 48 rigidly mounts the frame 18 to the lamp envelope 12 and prevents axial movement of the frame 18 in either direction. Electrical energy is coupled from a lamp base 45 through electrical inleads 47 and 49 to the arc tube 14. A strip of mica is sometimes positioned between strap 48 and lamp stem 46 in order to increase the electrical impedance between inleads 47 and 49 and frame 18.

As indicated previously, arc discharge lamps of the type shown in FIG. 1 have exhibited increases in operating voltage and color temperature, which are indicative of sodium loss from the arc tube. It is believed that the sodium loss is due to the comparatively low impedance between the electrical inleads 47 and 49 at the lamp stem 46 and the strap 48 at lamp operating temperatures. The charge built up on the shroud 16 and frame 18 due to the loss of photoelectrons and/or the gain in sodium ions is constantly neutralized by leakage currents through the lamp stem 46 between the strap 48 and inleads 47 and 49. As indicated above, a mica strip has been used under the strap 48 for reducing leakage currents. However, the mica strip is relatively expensive to implement and does not increase the lamp life to the extent desired.

The impedance between the strap 48 and inleads 47 and 49 has been measured both with and without a mica strip under strap 48. In addition, the impedance was measured with a nitrogen-filled lamp envelope 12 and with an evacuated lamp envelope. The impedance was highest when a mica strip was used in an evacuated lamp envelope. The presence of nitrogen or other gas in the lamp envelope promotes convective heat losses from the arc tube and raises the temperature of the lamp envelope and lamp stem of a lamp that is operated in the base-up configuration. The impedance of the glass used in the outer envelope is highly dependent on temperature and has a reduced impedance at higher temperatures. Thus, the impedance between strap 48 and inleads 47, 49 is reduced, and sodium loss is increased, when the operating temperature of the lamp stem is increased.

DETAILED DESCRIPTION OF THE INVENTION

Figure 2:
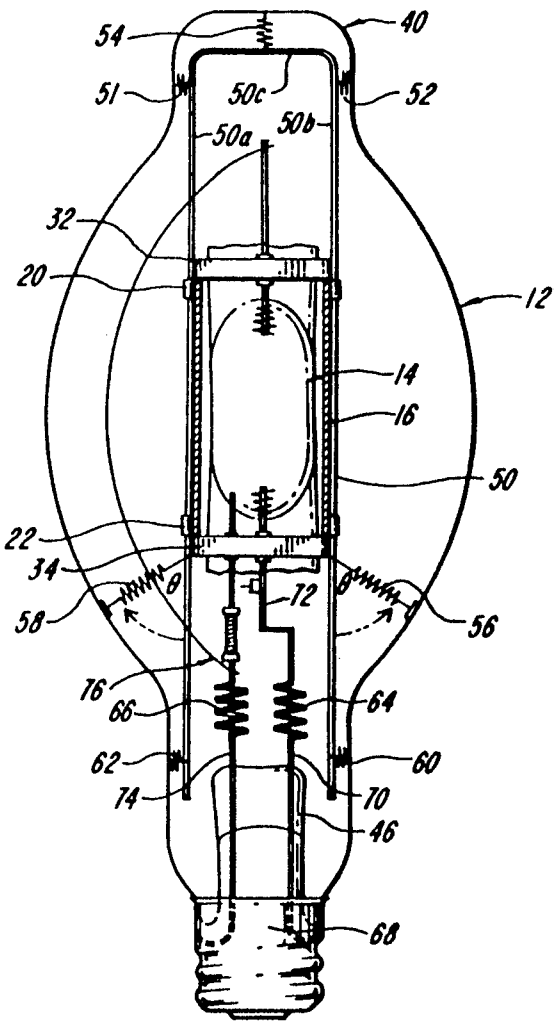
FIG. 2 is a schematic representation of an arc discharge lamp in accordance with the invention.

An arc discharge lamp in accordance with the present invention is shown schematically in FIG. 2. Corresponding elements in FIGS. 1 and 2 have the same reference numerals. The arc tube 14 and the shroud 16 are attached to a frame 50 by ring clips 20 and 22 and straps 32 and 34. The arc tube 14 comprises a conventional metal halide arc tube having electrodes at opposite ends and a starting electrode. The arc tube encloses a fill material including mercury and one or more metal halides. Sodium is typically present in the form of sodium iodide or sodium bromide. The shroud 16 is cylindrical and is fabricated of a light-transmissive, heat resistant material such as quartz. The straps 32 and 34 are attached to press seal regions of arc tube 14. The frame 50 is mechanically and electrically decoupled from the lamp stem 46 and is secured within the lamp envelope 12 by springs 51, 52, 54, 56, 58, 60, 62, 64 and 66. A subassembly including the frame 50, the shroud 16 and the arc tube 14 is supported entirely by the springs within the lamp envelope 12. The frame 50 is generally U-shaped and includes frame rods 50*a* and 50*b* which extend between the dome and base regions of the lamp envelope 12, and a frame cross member 50*c* which interconnects frame rods 50*a* and 50*b* at the dome end 40 of the lamp. The rods 50*a* and 50*b* terminate in the base region of the lamp envelope but are mechanically and electrically isolated from the lamp stem 46.

The springs 51, 52, 54, 56, 58, 60 and 62 are each coupled between frame 50 and lamp envelope 12. Springs 51, 52, 60 and 62 correspond generally to the bulb spacers used in prior art lamps. The spring 54 coupled between the dome end 40 of lamp envelope 12 and frame cross member 50*c* prevents excessive axial displacement of the frame 50. Axial and radial support for the frame 50 is provided by springs 56 and 58 which are mounted at an angle r with respect to frame rods 50*a* and 50*b*. For most effective support, the springs 56 and 58 are approximately perpendicular to the inside surface of lamp envelope 12 at the respective points of contact. The preferred angle r is approximately 45° such that the axial and radial forces exerted on frame 50 by springs 56 and 58 are approximately equal. However, values of the angle r between 20° and 70° provide adequate support for the frame 50. A conductive spring 64 is connected between high voltage inlead 70 and the base end electrode lead 72. A conductive spring 66 is connected between ground inlead 74 and connection wire 76. Springs 64 and 66 permit movement of the arc tube 14 relative to lamp envelope 12 and provide some support for the arc tube 14 in the axial direction.

Preferably, the springs 51, 52, 54, 56, 58, 60 and 62 shown in FIG. 2 are strips of spring stainless steel with indented dimples at the ends for contact with the glass of lamp envelope 12. It is important to avoid sharp projections in contact with the lamp envelope 12, which can be a source of cracking of the lamp envelope glass. Any material which is capable of withstanding the operating temperatures of the lamp and is resilient and deformable without permanently retaining the deformed shape, is suitable for the springs.

Figure 4:
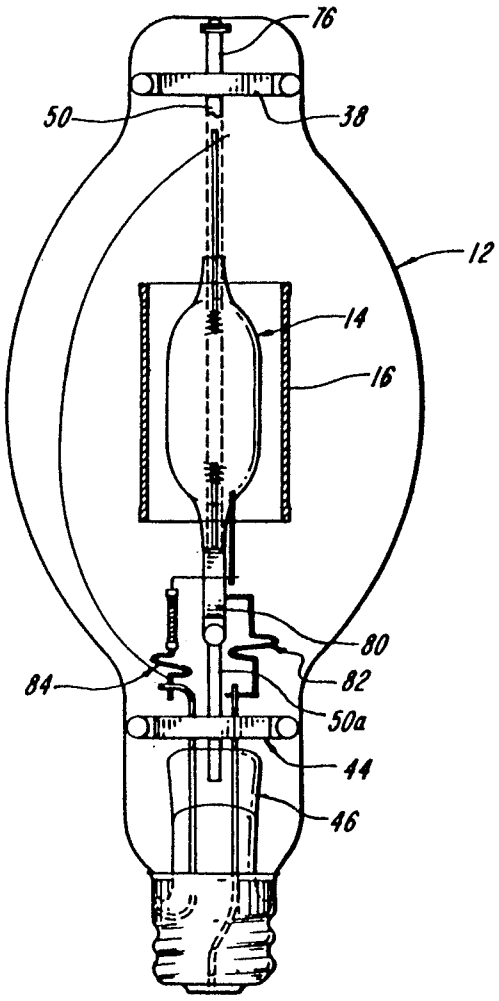
FIG. 4 is a cross-sectional view of the arc discharge lamp of FIG. 3 taken along the line 4—4 of FIG. 3.
Figure 3:
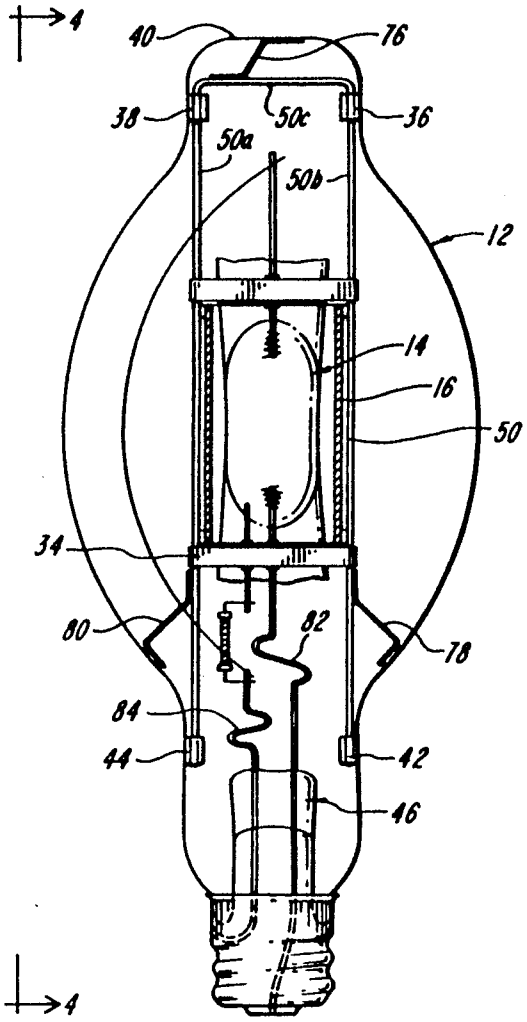
FIG. 3 is a cross-sectional view of an arc discharge lamp in accordance with a first embodiment of the invention.

A practical embodiment of the invention is shown in FIGS. 3 and 4. The springs 36, 38, 42 and 44 can comprise conventional bulb spacers as shown in FIG. 1. A spring 76 is coupled between the frame cross member 50*c* and dome end 40 of lamp envelope 12. A spring 78 is coupled between frame rod 50*b* and lamp envelope 12. A spring 80 is coupled between frame rod 50*a* and lamp envelope 12. The springs 76, 78 and 80 are strips of spring stainless steel welded to frame 50 and having dimples for contact with lamp envelope 12. Springs 82 and 84 are connected in series with the electrical inleads to arc tube 14. The springs 82 and 84 are fabricated of stiff wire capable of carrying the operating current for arc tube 14.

Figure 5:
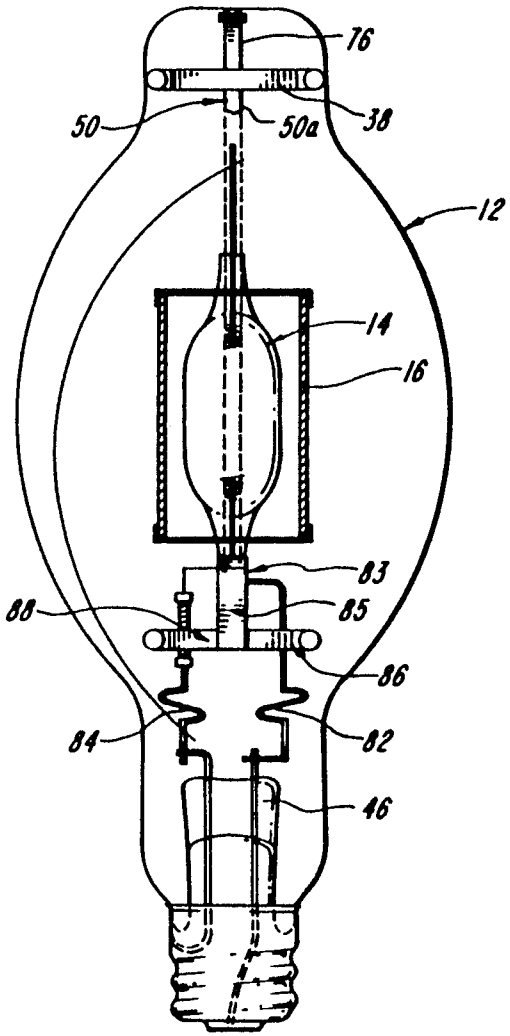
FIG. 5 is a cross-sectional view of an arc discharge lamp in accordance with a second embodiment of the invention.

A second embodiment of the invention is shown in FIG. 5. The lamp shown in FIG. 5 is the same as the lamp shown in FIGS. 3 and 4, except that the springs 42 and 44 shown in FIGS. 3 and 4 are omitted, and the lower end of the frame 50 is supported by a spring 83 attached to frame rod 50*a* and a similar spring (not shown) attached to frame rod 50*b*. The spring 83 includes an angled portion 85 and extensions 86 and 88 perpendicular to angled portion 85. The spring 83 limits radial and axial displacement of the frame 50 within the lamp envelope 12. Each of the extensions 86, 88 includes a dimple for contact with the lamp envelope 12.

Figure 6:
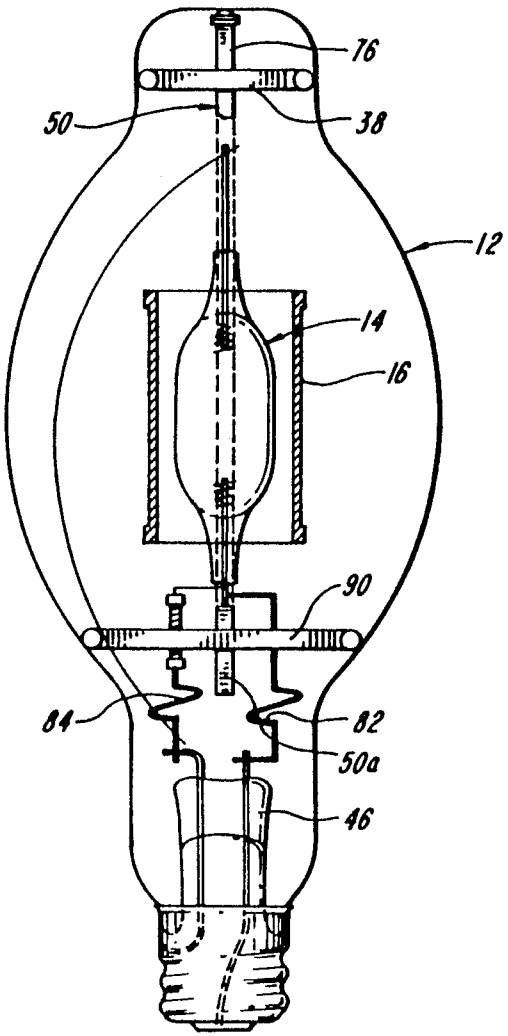
FIG. 6 is a cross-sectional view of an arc discharge lamp in accordance with a third embodiment of the invention.

A third embodiment of the invention is shown in FIG. 6. The lamp shown in FIG. 6 is the same as the lamp shown in FIG. 5, except that spring 83 is replaced by a spring 90 attached to frame rod 50*a* and a similar spring (not shown) attached to frame rod 50*b*. The spring 90 is a single strip of spring stainless steel which is welded directly to the frame rod 50*a*. The spring 90 is dimpled at each end to prevent cracking of the lamp envelope 12.

Figure 7:
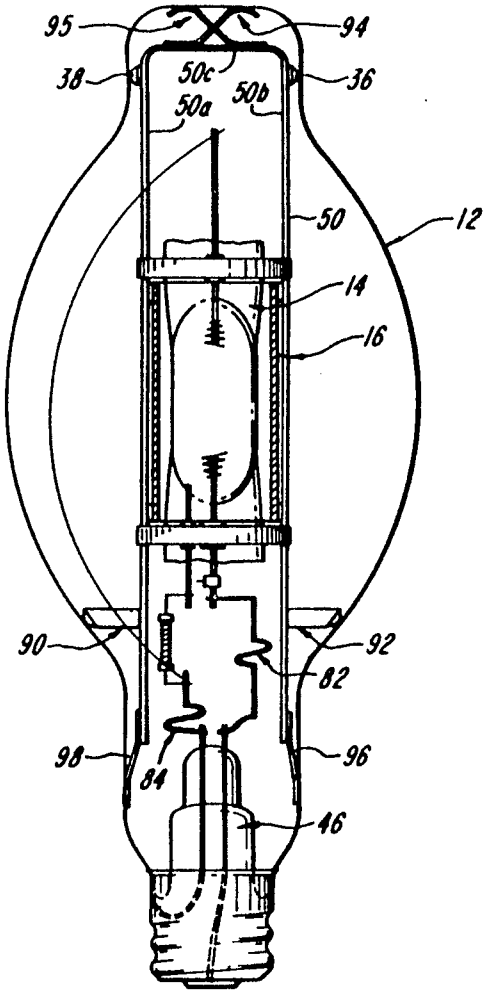
FIG. 7 is a cross-sectional view of an arc discharge lamp in accordance with a fourth embodiment of the invention.

A fourth embodiment of the invention is shown in FIG. 7. The lamp shown in FIG. 7 is the same as the lamp shown in FIG. 6, except that spring 76 of FIG. 6 is replaced by two strips of spring stainless steel 94 and 95 welded to frame cross member 50*c*. In addition, a spring 96 is coupled between the base end of frame rod 50*b* and lamp envelope 12, and a spring 98 is coupled between the base end of frame rod 50*a* and lamp envelope 12. The springs 96 and 98 can be strips of spring stainless steel welded to the respective frame rods.

The embodiments shown in FIGS. 3–7 and described hereinabove are characterized by having a subassembly, including arc tube 14, shroud 16 and frame 50, which is mechanically supported by a plurality of resilient spring members. Frame 50 is mechanically and electrically isolated from the lamp stem 46 so that leakage current between the frame 50 and the electrical inleads is eliminated. The springs securely mount the subassembly within the lamp envelope 12 for normal operation but permit a small amount of relative movement between the subassembly and the lamp envelope in the event of mechanical shock or vibration.

Figure 8:
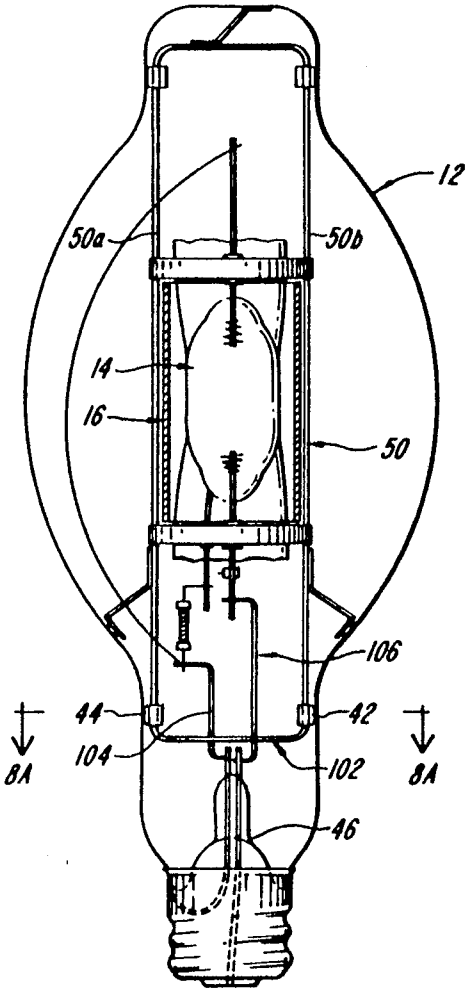
FIG. 8 is a cross-sectional view of an arc discharge lamp including a frame reinforcing member in accordance with the invention.
Figure 8A:
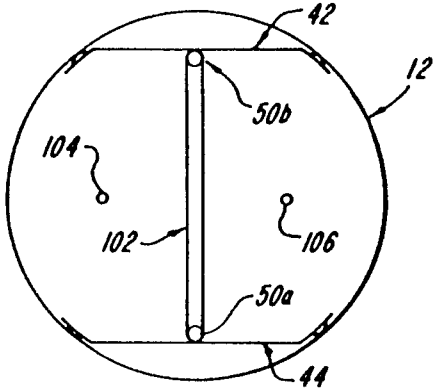
FIG. 8A is a cross-sectional view taken along the line 8A—8A of FIG. 8.

It has been found that when the lamp structure shown in FIG. 3 is subjected to severe vibration or mechanical shock, the frame rods 50*a* and 50*b* can bend, thereby failing to support the arc tube 14 and shroud 16 in the desired position at the center of lamp envelope 12. With reference to FIG. 2, frame rods 50*a* and 50*b* are most likely to bend near strap 34 at the base end of shroud 16. An embodiment of the invention with a strengthened frame is shown in FIGS. 8 and 8A. The arc discharge lamp of FIG. 8 is the same as the lamp of FIG. 3, except that a reinforcing member or portion is added to frame 50. The reinforcing member comprises a lower cross member 102 that is connected between rods 50*a* and 50*b* near the base region of lamp envelope 12 and near springs 42 and 44. Electrical inleads 104 and 106 are spaced to pass around cross member 102, as shown in FIG. 8A. The cross member 102 can be either an integral continuation of frame rods 50*a* and 50*b* or a separate member welded to frame rods 50*a* and 50*b*.

Figure 9A:
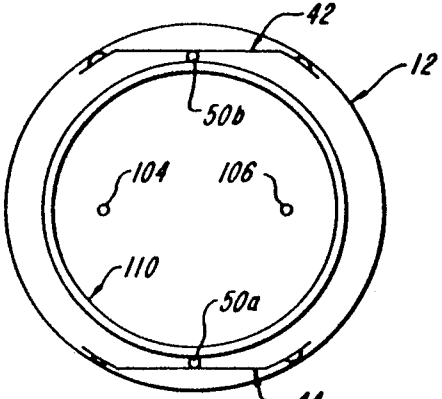
FIGS. 9A–9D are cross-sectional views taken along the line 9A–9A of FIG. 9, showing different embodiments of the frame reinforcing member.
Figure 9:
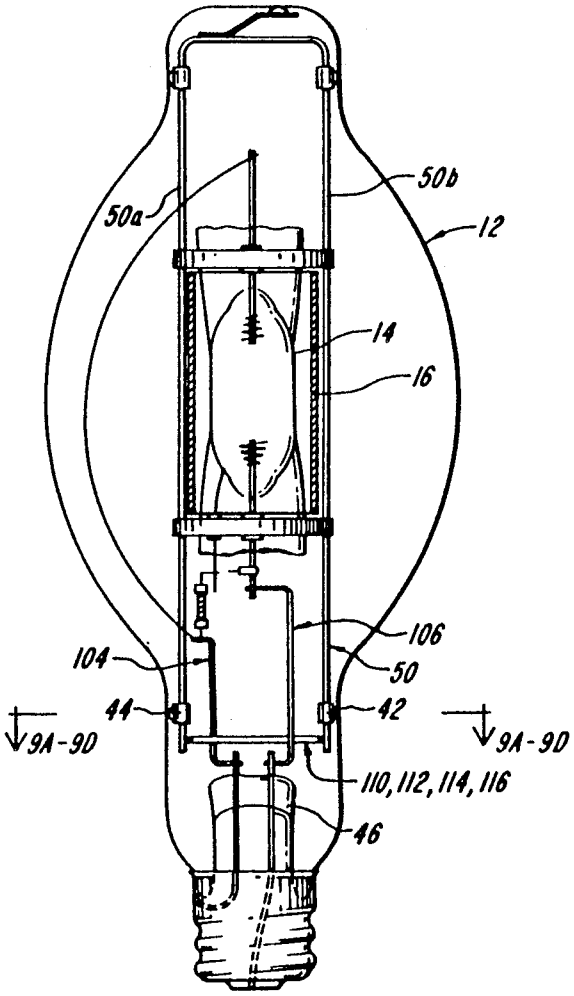
FIG. 9 is a cross-sectional view of an arc discharge lamp which utilizes another embodiment of the frame reinforcing member.
Figure 9B:
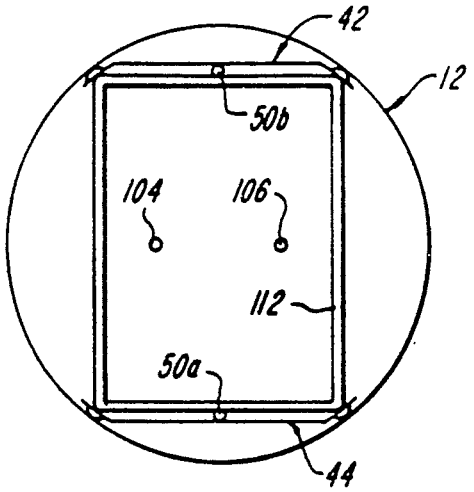
Figure 9C:
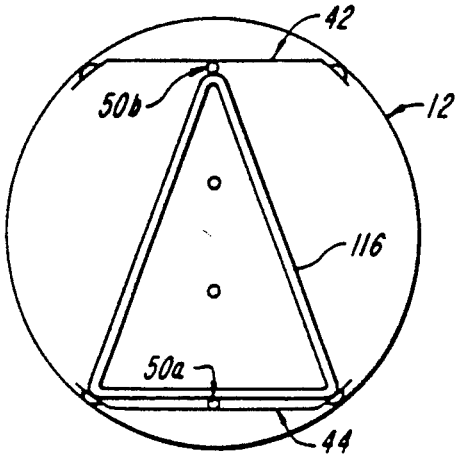
Figure 9D:
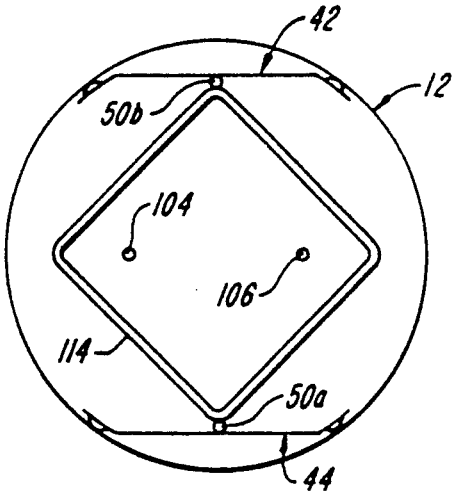

Another embodiment of an arc discharge lamp with a frame having a reinforcing member at or near the base end is shown in FIG. 9. The lamp of FIG. 9 is the same as the lamp of FIG. 8, except that cross member 102 is replaced with a ring 110 attached to frame rods 50*a* and 50*b* in the base region of the lamp. As shown in FIG. 9A, the ring 110 is attached to frame 50 near the lower ends of frame rods 50*a* and 50*b*. The ring 110 of FIG. 9A has a generally circular shape. Other possible configurations of the reinforcing member are shown in FIGS. 9B–9D. In each case, a reinforcing member in the form of a ring or closed loop member is welded or otherwise attached to rods 50*a* and 50*b* so as to strengthen the lower end of the frame 50. Square or rectangular reinforcing members 112 and 114 are shown in FIGS. 9B and 9D, respectively. A triangular reinforcing member 116 is shown in FIG. 9C.

In summary, the lamps shown in FIGS. 8, 8A, 9 and 9A–9D include a subassembly comprising arc tube 14, shroud 16 and frame 50, which is mechanically supported by a plurality of resilient spring members. The frame is mechanically and electrically isolated from the lamp stem 46 so as to eliminate leakage current between frame 50 and the electrical inleads. The spring mounting of the subassembly provides a lamp that can withstand vibration and mechanical shock. Resistance to vibration and mechanical shock is increased by the reinforced frame configuration including the reinforcing member near the base region of lamp envelope 12.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a sealed lamp envelope including a lamp stem;

a lamp subassembly located within said lamp envelope, said lamp subassembly including a lamp capsule for generating light upon application of electrical energy, a generally cylindrical, light-transmissive shroud disposed around said lamp capsule, first and second retainers attached to opposite ends of said lamp capsule and retaining said shroud between them, and a frame extending between dome and base regions of said lamp envelope, said first and second retainers being attached to said frame, said frame being mechanically and electrically isolated from said lamp stem;

means for coupling electrical energy through said lamp stem to said lamp capsule, said means for coupling being electrically isolated from said frame; and plural springs coupled between said lamp subassembly and said lamp envelope for resilient mounting of said lamp subassembly, said plural springs providing mechanical support for said lamp subassembly in said lamp envelope.

2. An electric lamp as defined in claim 1 wherein said plural springs include springs coupled between said frame and said lamp envelope.

3. An electric lamp as defined in claim 1 wherein said lamp envelope has a central axis and wherein said plural springs limit axial and radial movement of said lamp subassembly relative to said lamp envelope.

4. An electric lamp as defined in claim 3 wherein said plural springs include at least one end spring coupled between said frame and the dome end of said lamp envelope for limiting axial movement of said lamp subassembly.

5. An electric lamp as defined in claim 3 wherein said plural springs include at least one angled spring coupled between said frame and said lamp envelope and oriented at an acute angle relative to said axis so as to limit both axial and radial movement of said lamp subassembly relative to said lamp envelope.

6. An electric lamp as defined in claim 5 wherein said angled spring is positioned so as to limit movement of said lamp subassembly toward said lamp stem.

7. An electric lamp as defined in claim 5 wherein said acute angle is in a range of about 20° to 70°.

8. An electric lamp as defined in claim 1 wherein said means for coupling electrical energy includes electrical inleads extending through said lamp stem and connected to said lamp capsule, each of said inleads including a resilient portion permitting movement of said lamp subassembly relative to said lamp envelope.

9. An electric lamp as defined in claim 1 wherein each of said springs coupled between said frame and said lamp envelope comprises a strip of spring material having at least one dimple for contact with said lamp envelope., 10. An electric lamp as defined in claim 1 wherein said frame comprises first and second frame rods extending along opposite sides of said shroud, said frame further including a reinforcing member connected between said first and second frame rods near the base region of said lamp envelope.

11. An electric lamp as defined in claim 10 wherein said reinforcing member comprises a cross member connected between said first and second frame rods.

12. An electric lamp as defined in claim 10 wherein said reinforcing member comprises a ring connected to said first and second frame rods.

13. An electric lamp as defined in claim 3 wherein said frame comprises first and second frame rods extending along opposite sides of said shroud between dome and base regions of said lamp envelope, said plural springs being coupled between said first frame rod and said lamp envelope and between said second frame rod and said lamp envelope.

14. An electric lamp as defined in claim 13 wherein said plural springs include a first angled spring coupled between said first frame rod and said lamp envelope and a second angled spring coupled between said second frame rod and said lamp envelope, said first and second angled springs each being oriented at an acute angle relative to said axis so as to limit axial and radial movement of said lamp subassembly relative to said lamp envelope.

15. An arc discharge lamp comprising:

a sealed lamp envelope including a lamp stem;

a subassembly located within said lamp envelope, said subassembly including a metal halide arc tube for generating light upon application of electrical energy, a generally cylindrical, light-transmissive shroud disposed around said arc tube, first and second straps attached to opposite ends of said arc tube and retaining said shroud between them, and a frame extending between dome and base regions of said lamp envelope, said first and second straps being attached to said frame, said frame being mechanically and electrically isolated from said lamp stem;

electrical inleads for coupling electrical energy through said lamp stem to said arc tube, said electrical inleads being mechanically and electrically isolated from said frame; and resilient members coupled between said frame and said lamp envelope for resilient mounting of said subassembly, said resilient members limiting axial and radial movement of said subassembly relative to said lamp envelope.

16. An arc discharge lamp as defined in claim 15 wherein said resilient members include angled springs coupled between said frame and said lamp envelope, each angled spring being oriented at an acute angle relative to a central axis of said lamp envelope so as to limit both axial and radial movement of said subassembly relative to said lamp envelope.

17. An arc discharge lamp as defined in claim 15 wherein said frame comprises first and second frame rods extending along opposite sides of said shroud between dome and base regions of said lamp envelope, said resilient members including a first angled spring coupled between said first frame rod and said lamp envelope and a second angled spring coupled between said second frame rod and said lamp envelope, said first and second angled spring each being oriented at an acute angle relative to a central axis of said lamp envelope so as to limit axial and radial movement of said subassembly relative to said lamp envelope.

18. An arc discharge lamp as defined in claim 17 wherein said acute angle is in a range of about 20° to 70°.

19. An arc discharge lamp as defined in claim 17 wherein said acute angle is about 45°.

* * * * *